US009169033B2

(12) United States Patent
Ehrmann et al.

(10) Patent No.: US 9,169,033 B2
(45) Date of Patent: Oct. 27, 2015

(54) SEALING STATION FOR A PACKAGING MACHINE

(75) Inventors: Elmar Ehrmann, Bad Grönenbach (DE); Herbert Kirmse, Wolfertschwenden (DE)

(73) Assignee: MULTIVAC SEPP HAGGENMULLER GMBH & CO. KG, Wolfertschwenden (DE)

( * ) Notice: Subject to any disclaimer, the term of this patent is extended or adjusted under 35 U.S.C. 154(b) by 1075 days.

(21) Appl. No.: 13/100,703

(22) Filed: May 4, 2011

(65) Prior Publication Data

US 2011/0271650 A1 Nov. 10, 2011

(30) Foreign Application Priority Data

May 6, 2010 (DE) ..... 10 2010 019 635

(51) Int. Cl.
*B65B 31/02* (2006.01)

(52) U.S. Cl.
CPC ..... *B65B 31/028* (2013.01)

(58) Field of Classification Search
CPC ... B65B 31/028; B65B 31/024; F04C 23/001; F04C 23/02; F04C 2240/20
USPC ..... 53/375.8, 79, 84, 11 R, 510, 329.2, 53/329.3, 511, 559
See application file for complete search history.

(56) References Cited

U.S. PATENT DOCUMENTS

| | | | | |
|---|---|---|---|---|
| 4,424,659 | A * | 1/1984 | Perigo et al. | 53/425 |
| 4,567,713 | A * | 2/1986 | Natterer | 53/433 |
| 4,584,821 | A * | 4/1986 | Booth | 53/448 |
| 5,056,292 | A * | 10/1991 | Natterer | 53/86 |
| 5,481,852 | A * | 1/1996 | Mitchell | 53/432 |
| 5,532,011 | A | 7/1996 | Goglio | |
| 6,012,265 | A | 1/2000 | Ady | |
| 6,354,823 | B1 | 3/2002 | Becher et al. | |
| 7,140,167 | B2 * | 11/2006 | Countz | 53/510 |
| 2005/0238502 | A1 * | 10/2005 | Durand et al. | 417/250 |
| 2008/0050262 | A1 * | 2/2008 | Jacobsen et al. | 418/191 |
| 2009/0272071 | A1 * | 11/2009 | Tam | 53/79 |

FOREIGN PATENT DOCUMENTS

| | | | |
|---|---|---|---|
| CH | 332587 | A | 9/1958 |
| CN | 2177677 | Y | 9/1994 |
| CN | 2235412 | Y | 9/1996 |

(Continued)

OTHER PUBLICATIONS

Extended European Search Report Dated Sep. 20, 2011, Applicant Multivac Sepp Haggenmueller & Co. KG, Application No. 11003668.8-2308, 4 Pages.

(Continued)

*Primary Examiner* — Andrew M Tecco

(74) *Attorney, Agent, or Firm* — Husch Blackwell LLP

(57) ABSTRACT

A sealing station for a packaging machine comprises a sealing tool for sealing packages, an underpressure source for evacuating packages in the sealing station, and an overpressure source for providing compressed air so as to press the sealing tool against a package. A single drive is provided for the underpressure source and the overpressure source, the underpressure source and/or the overpressure source being a pump that is configured as a rotary vane pump or as a helical pump.

12 Claims, 3 Drawing Sheets

(56) References Cited

FOREIGN PATENT DOCUMENTS

| | | | |
|---|---|---|---|
| DE | 7148927 | U | 12/1971 |
| DE | 2348441 | A1 | 3/1975 |
| DE | 3842135 | A1 | 6/1990 |
| DE | 3916170 | A1 | 11/1990 |
| DE | 19629174 | A1 | 1/1998 |
| DE | 69406381 | T2 | 4/1998 |
| DE | 102006018327 | A1 | 10/2006 |
| DE | 102005061315 | A1 | 6/2007 |
| GB | 786416 | | 11/1957 |
| WO | 9954627 | A1 | 10/1999 |

OTHER PUBLICATIONS

Chinese Office Action dated Aug. 1, 2012, Applicant Multivac Sepp Haggenmüller GmbH & Co. KG, Application No. 201110117414.9, 13 pages including translation.

German Office Action Dated Mar. 3, 2011, Applicant Multivac Sepp Haggenmueller GmbH & Co. KG, Application No. 10 2010 019 635.5-27, 3 Pages.

* cited by examiner

SEALING STATION FOR A PACKAGING MACHINE

CROSS-REFERENCE TO RELATED APPLICATIONS

This application claims foreign priority benefits under 35 U.S.C. §119(a)-(d) to German patent application number DE 10 2010 019 635.5, filed May 6, 2010, which is incorporated by reference in its entirety.

TECHNICAL FIELD

The present disclosure relates to a sealing station for a packaging machine.

BACKGROUND

A packaging machine comprising a sealing station is known e.g. from DE 10 2006 018 327 A1, the packaging machine there being a tray sealer. In the sealing station of this packaging machine, a sealing film is applied to the trays which are open at the top and filled with the product in question. This sealing film closes and seals the trays. A corresponding sealing station is also used in thermoformer packaging machines or in chamber machines. Alternatively to sealingly applying a cover film, also a lid, which has already been preformed, may be sealingly applied to the tray or the packaging trough.

For the purpose of sealing, it will be of advantage when underpressure as well as overpressure are available. By means of the underpressure, the packages can be evacuated in the sealing station so as to increase the shelf life of the products. Optionally, the package may be flushed by or filled with an exchange gas after evacuation. The sealing itself is normally executed under the influence of pressure and temperature on the sealing film. To this end, an overpressure source is normally provided, which provides the compressed air used for pressing the sealing tool against the package.

Compressed air and underpressure are also used in other areas of a packaging machine. DE 10 2005 061 315 A1, for example, shows a packaging machine in which overpressure and underpressure are used not in a sealing station but in a thermoforming station. For generating these pressures, a claw vacuum pump is provided.

Such a claw pump is described e.g. in DE 19629174 A1.

Other devices making use of overpressure and underpressure for deforming packaging films, but not for sealing such packaging films, are disclosed by DE 3842135 A1 or CH 332587.

SUMMARY

It is an object of the present disclosure to improve a sealing station for a packaging machine with respect to a reliable, energy-efficient operation with the aid of means having the simplest possible structural design.

According to the present disclosure, a single drive is provided for the underpressure source as well as for the overpressure source. This is a measure that makes the sealing station very compact and, in comparison with the use of a plurality of drives, it will be less susceptible to faults. In addition, the sealing station according to the present disclosure is rendered particularly efficient and easy to maintain by the circumstance that a pump used as underpressure source and/or overpressure source is a rotary vane pump or a helical pump.

The sealing station can be operated in a particularly energy- and cost-efficient manner due to the fact that a single pump generates the underpressure for evacuating the packages as well as the compressed air for applying pressure to the sealing tool. The reason for this is that the pump will better be used to capacity, since it avoids idle times or down times. In addition, the pump will be prevented from working excessively long against closed valves.

If higher pumping power seems to be necessary, e.g. for generating a lower underpressure or a higher overpressure, it may be more advantageous to provide two (or even more than two) pumps as underpressure and overpressure sources. According to the present disclosure, all the pumps can still be driven by a single common drive, e.g. by means of a common output shaft of a motor.

If a plurality of pumps is provided, it may be advantageous when the different pumps can selectively be switched on and off.

When a pump is configured as a rotary vane pump, said rotary vane pump preferably comprises three vanes. This guarantees a particularly silent operation of the pump.

It will be advantageous when there are provided a compressed air reservoir connected to the (underpressure) pump and/or an underpressure reservoir connected to the (overpressure) pump. In this way, the operating time of the pumps is fully utilized. Compressed air or underpressure is either supplied directly to the sealing station, or the respective reservoirs are filled or evacuated.

A three-way valve can be provided upstream of the intake opening of the underpressure pump. This enables the pump to evacuate the underpressure reservoir and, selectively, to take in ambient air.

When the intake opening of the pump communicates with the ambient air via a first inlet of the three-way valve, overpressure can be generated more easily and more effectively than in cases in which the intake opening of the pump is permanently connected to the underpressure reservoir.

A second inlet of the three-way valve can, however, communicate with the chamber of the sealing station or with an underpressure reservoir. Thus, it is either possible to generate an underpressure directly in the sealing chamber or to lower the pressure in the underpressure reservoir still further.

It is imaginable that a controller is provided for controlling the operation of the pump and/or of the three-way valve. This controller adapts the operation of the pump perfectly to the operating cycle of the sealing station and of the whole packaging machine, respectively.

The present disclosure also relates to a packaging machine comprising a sealing station of the type described hereinbefore.

In the following, advantageous embodiments of the present disclosure will be explained in more detail on the basis of the below drawings.

DETAILED DESCRIPTION

Figure 1:
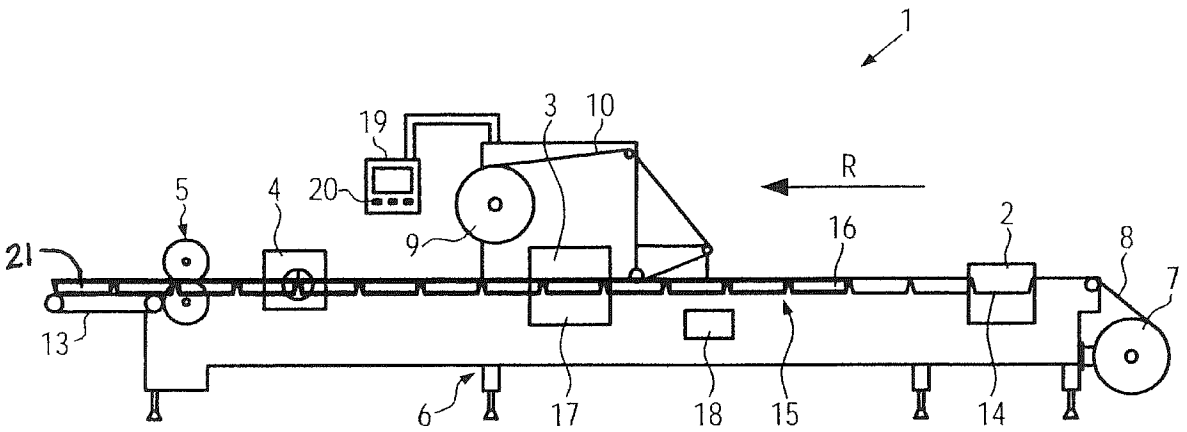
FIG. 1 is a schematic side view of a packaging machine according to the present disclosure in the form of a thermoformer packaging machine.

Identical components are provided with identical reference numerals throughout the figures.

FIG. 1 shows a schematic view of a packaging machine 1 in the form of a thermoformer packaging machine. This thermoformer packaging machine 1 comprises a forming station 2, a sealing station 3, a transverse cutting device 4 and a longitudinal cutting device 5, which are arranged in this order in a working direction R on a machine frame 6. On the input side a supply roll 7 is provided on the machine frame 6, from which a first web material 8 is unwound. In the area of the sealing station 3, a material storage unit 9 is provided, from which a second web material 10 used as a cover film is unwound. On the output side a discharge device 13 in the form of a transport conveyor is provided at the packaging machine, with which finished, singulated packages are transported away. Furthermore, the packaging machine 1 comprises a feeding device which is not shown, said feeding device gripping the first web material 8 and transporting it cyclically in a main work cycle in the working direction R. The feeding device can be realized, for example, by laterally arranged transport chains.

In the embodiment shown, the forming station 2 is realized as a thermoforming station in which containers 14 are formed in the first web material 8 by thermoforming. The forming station 2 can be configured such that in the direction perpendicular to the working direction R several containers are formed side by side. In the working direction R behind the forming station 2, a filling area 15 is provided, in which the containers 14 formed in the first web material 8 are filled with the product 16.

The sealing station 3 is provided with a closable chamber 17 in which the atmosphere in the containers 14 can be substituted, prior to sealing, by an exchange gas or by an exchange gas mixture e.g. by gas flushing.

The transverse cutting device 4 is configured as a punch separating the first web material 8 and the second web material 10 in a direction transversely to the working direction R between neighbouring containers 14. In so doing, the transverse cutting device 4 works such that the first web material 8 is not cut across the whole width of the web, but remains uncut in at least an edge area. This allows controlled further transport by the feeding device.

In the embodiment shown, the longitudinal cutting device 5 is configured as a blade arrangement by means of which the first web material 8 and the second web material 10 are cut between neighbouring containers 14 and at the lateral edge of the first web material 8, so that, downstream of the longitudinal cutting device 5, singulated packages are obtained.

The packaging machine 1 is additionally provided with a controller 18. It is used for controlling and monitoring the processes taking place in the packaging machine 1. A display device 19 with operating controls 20 serves to make the sequences of process steps in the packaging machine 1 visible to an operator and to influence them by the operator.

The general mode of operation of the packaging machine 1 will be described briefly in the following.

The first web material 8 is unwound from the supply roll 7 and conveyed into the forming station 2 by the feeding device. In the forming station 2, containers 14 are formed in the first web material 8 by thermoforming. Together with the material of the first web material 8 surrounding them, the containers 14 are advanced, in a main work cycle, to the filling area 15 where they are filled with the product 16.

Subsequently, the filled containers 14 are, together with the material of the first web material 8 surrounding them, advanced by the feeding device into the sealing station 3 during the main work cycle. After having been sealed onto the first web material 8, the second web material 10 is advanced as a cover film when the feed motion of the first web material 8 takes place. In the course of this process, the second web material 10 is unwound from the material storage unit 9. By sealing the cover film 10 onto the containers 14, closed packages 21 are obtained.

Figure 2:
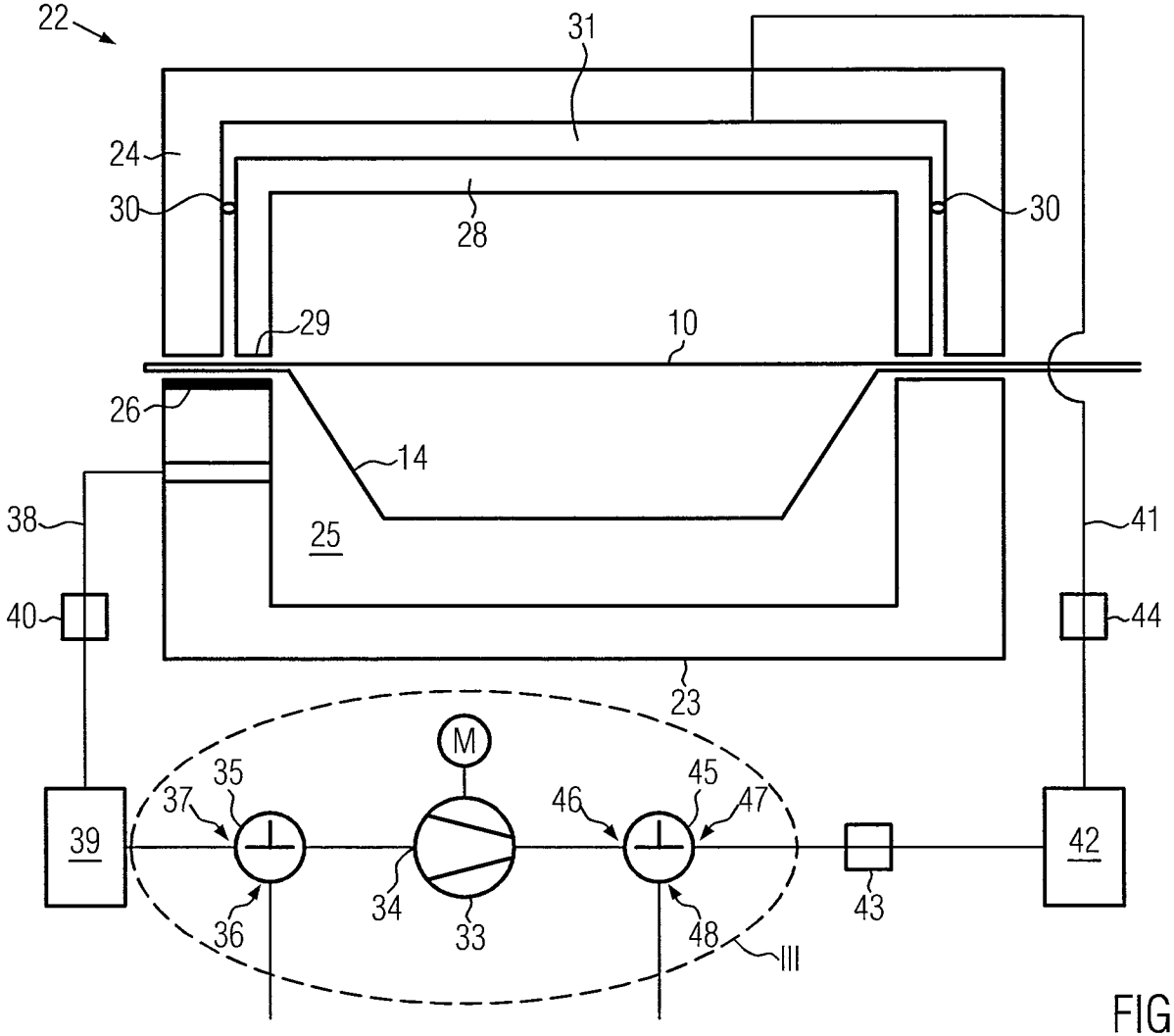
FIG. 2 is a schematic vertical section through a sealing station according to the present disclosure.

FIG. 2 shows, in a schematic view, a vertical section through a sealing tool 22 of the sealing station 3. The sealing tool 22 comprises a sealing tool bottom 23 and a sealing tool top 24. The sealing tool bottom 23 has provided therein a hollow or cavity 25. The cavity 25 can have arranged therein a container 14 to be closed, whereas the edge 26 of the sealing tool bottom 23 carries the edge of the container 14.

In the interior of the sealing tool top 24, a sealing plate 28 with downwardly projecting sealing edges 29 is provided. A product protection plate (not shown) is optionally provided within the sealing plate 28. The product protection plate is cooler than the sealing plate 28 and prevents excessive heating of the product 16 in the container 14 during the sealing process.

The sealing plate 28 is sealed from the outer wall of the sealing tool top 24 via gaskets 30. Within a pressure chamber 31 between the sealing plate 28 and the outer wall of the sealing tool top 24 an overpressure can be applied for forcing the sealing plate 28 downwards under pressure. In addition, a heating unit (not shown) is provided so as to heat the sealing plate 28, in particular the sealing edges 29 thereof, to the sealing temperature.

In the embodiment according to FIG. 2, the sealing station 3 according to the present disclosure is provided with a pump 33, which is configured as a rotary vane pump or as a helical pump and which generates underpressure for evacuating the packages 14 as well as overpressure for applying pressure to the sealing tool 28. The (single) pump 33 is driven by a drive M, e.g. an electric motor.

An intake opening 34 of the pump 33 is preceded by a three-way valve 35. A first inlet 36 of the three-way valve communicates with the ambient air of the sealing station 3. A second inlet 37 of the three-way valve 35 communicates with an underpressure line 38, which is connected to the chamber 25 of the sealing station 3. The three-way valve 35 and the sealing chamber 25 of the sealing station 3 have provided between them an underpressure reservoir 39 and a valve 40.

The overpressure side of the pump 33 communicates with an overpressure line 41 connected to the sealing pressure chamber 31 of the sealing tool 22. The compressed air line 41 has incorporated therein a compressed air reservoir 42 for storing overpressure. Check valves 43, 44 are arranged upstream as well as downstream of the compressed air reservoir 42 in the compressed air line 41.

A second three-way valve 45 is provided in the compressed air line 41 between the pump 33 and the first check valve 43. Said second three-way valve 45 may also fully replace the check valve 43. A first inlet 46 of the three-way valve 45 communicates with the overpressure side of the pump 33. A second inlet 47 leads to the overpressure reservoir 42, whereas a third inlet 48 communicates with the ambient air of the sealing station 3.

When the second three-way valve 45 between the first inlet 46 and the third inlet 48 is open, the pump 33 can generate underpressure without having to work against the overpressure in the compressed air reservoir 42. If, however, the pressure in the compressed air reservoir 42 is to be increased by means of the pump 33, the second three-way valve 45 between the first inlet and the second inlet 47 will be open, whereas the third inlet 48 will be closed.

The pump 33 as well as the three-way valves 35, 45 and the check valves 40, 43, 44 are connected to the controller 18 via control lines (not shown). By means of suitable control signals, the controller 18 adapts the operating sequence of the pump 33 and of the valves 35, 40, 43, 44, 45 to the operating sequence of the sealing station 3.

As soon as the sealing chamber 25 closes around a package 14 that has been filled but not yet sealed, the check valve 40 is opened and, subsequently or simultaneously, the three-way valve 35 between the underpressure reservoir 39 and the pump 33 is opened. Due to the underpressure prevailing in the underpressure reservoir 39 and the operation of the pump 33, a vacuum is generated in the sealing chamber 25 so as to evacuate the package 14.

When the check valve 44 is opened, a first overpressure from the pressure reservoir 42 is applied to the sealing pressure chamber 31 and causes the sealing plate 28 to move downwards. In order to increase this pressure, the three-way valve 35 between the pump 33 and the first inlet 36 is opened, whereas the second inlet 37 of the three-way valve 35 is closed. In this way, a connection between the pump 33 and the ambient air is established. Subsequently, the check valve 43 is opened, and the second three-way valve 45 is opened between its inlets 46 and 47. The pump 33 now generates an additional overpressure which increases the pressure in the sealing pressure chamber 31 still further. This has the effect that the sealing plate 28 is forced downwards so that the sealing film 10 will be sealingly connected to the containers 14 under the sealing edges 29 of said sealing plate 28.

After the sealing process, the check valve 44 is closed and the sealing pressure chamber 31 is vented so that the sealing tool 28 will be raised again. Also the check valve 40 is closed. When the sealing chamber 25 has opened due to a movement of the sealing tool bottom 23 and the sealing tool top 24 in opposite directions, the sealed container 14 can be removed.

While the next container 14 is being conveyed into the sealing station 3, the pump 33 can evacuate the underpressure reservoir 39 and/or fill the pressure reservoir 42.

Figure 3:
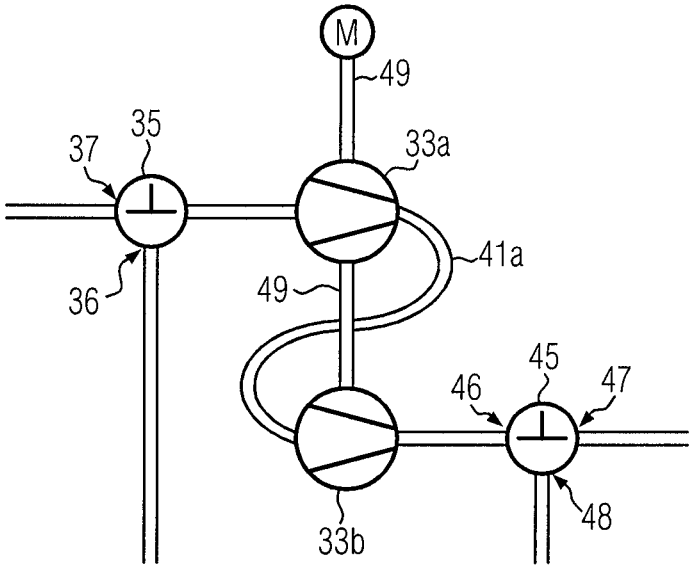
FIG. 3 is a schematic representation of the pump arrangement of a second embodiment.

FIG. 3 shows a schematic view of a second embodiment of the sealing station area designated by III in FIG. 2. This second embodiment differs from the first embodiment insofar as, instead of a single pump, two pumps 33*a*, 33*b* are provided. These two pumps are connected to the output shaft 49 of a common drive M so that both pumps 33*a*, 33*b* are operated by the same drive M.

Each of said pumps 33*a*, 33*b* may have provided thereon a clutch or a switching means so that the respective pump 33*a*, 33*b* can selectively be connected to the drive M. The two pumps 33*a*, 33*b* may be optimized for different pressure ranges. For example, the first pump 33*a* may be optimized for a low pressure range so as to act as an underpressure source, whereas the second pump 33*b* may be optimized for a higher pressure range than the first pump 33*a* so as to serve as an overpressure source.

The two pumps 33*a*, 33*b* are arranged in succession one after the other between the two three-way valves 35, 45. A portion 41*a* of the compressed air line 41 interconnects the two pumps 33*a*, 33*b*. The two pumps 33*a*, 33*b* may be rotary vane pumps or helical pumps, for example. Both pumps 33*a*, 33*b* may be pumps of the same type or they may be different types of pumps.

If a pump 33*a* for generating a vacuum and a second pump 33*b* for generating compressed air should be operated simultaneously, it will be advantageous not to provide the portion 41*a* of the compressed air line 41 or to open said portion 41*a*, so that ambient air will be available at the discharge side of the vacuum-generating pump 33*a* and at the intake side of the compressed air-generating pump 33*b*. This will provide optimized flow conditions at both pumps 33*a*, 33*b*.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A sealing station for a packaging machine, the sealing station comprising:

an outer wall;

a sealing plate for sealing packages, said sealing plate disposed interior of said outer wall;

a pressure chamber between said sealing plate and said outer wall;

an underpressure source for evacuating a package in the sealing station, the underpressure source comprising a first pump;

an overpressure source for providing compressed air into said pressure chamber so as to press the sealing plate against a package in the sealing station, the overpressure source comprising a second pump, said first pump and said second pump separated by a distance; and a single drive comprising a drive motor and a drive shaft rotated by said drive motor, said drive shaft having a length, and wherein said first pump is operably connected to said drive shaft at a first location along the length and said second pump is operably connected to said drive shaft at a second location along the length such that said first pump and said second pump are both driven by said drive shaft.

2. A sealing station according to claim 1 wherein the first pump and the second pump each have an intake opening and the sealing station further comprises a three-way valve provided upstream of the intake opening of one of the first pump or the second pump;

wherein the three-way valve has a first port in fluid communication with ambient air; and wherein the three-way valve has a second port in fluid communication with a chamber of the sealing station or with a pressure reservoir of the sealing station.

3. A sealing station according to claim 2 further comprising a second three-way valve disposed downstream of the intake opening of one of the first pump or the second pump.

4. A sealing station according to claim 1 further comprising a compressed air reservoir and/or an underpressure reservoir.

5. A sealing station according to claim 4 wherein one of the compressed air reservoir or the underpressure reservoir is connected to one of the first pump or the second pump.

6. A packaging machine comprising a sealing station according to claim 1.

7. A sealing station according to claim 1 further comprising an air line disposed between the first pump and the second pump to place the first pump in fluid communication with the second pump.

8. A sealing station for a packaging machine, the sealing station comprising:

a sealing plate for sealing packages;

an underpressure source for evacuating a package in the sealing station;

an overpressure source for providing compressed air so as to press the sealing plate against a package; and a single drive shaft disposed for rotation to drive the underpressure source and the overpressure source, and one of the underpressure source or the overpressure source comprising a pump configured as a rotary vane pump or as a helical pump, wherein the single drive shaft drives the pump;

wherein the pump has an intake opening and the sealing station further comprises a three-way valve provided upstream of the intake opening of the pump;

wherein the three-way valve has a first port in fluid communication with ambient air;

wherein the three-way valve has a second port in fluid communication with a chamber of the sealing station or with an underpressure reservoir of the sealing station; and wherein the three-way valve has a third port in fluid communication with the intake opening of the pump.

9. A sealing station according to claim 8 wherein the underpressure source is a first pump and the overpressure source is a second pump separated from said first pump by a distance, and the first pump and the second pump are both driven by the single drive shaft.

10. A sealing station according to claim 8 further comprising a compressed air reservoir, wherein one of the compressed air reservoir or the underpressure reservoir is in fluid communication with the pump.

11. A sealing station according to claim 8 further comprising an additional three-way valve disposed downstream of the intake opening of the pump.

12. A packaging machine comprising a sealing station according to claim 8.

* * * * *